US007315287B2

(12) United States Patent
Shigihara

(10) Patent No.: US 7,315,287 B2
(45) Date of Patent: Jan. 1, 2008

(54) ANTENNA DEVICE HAVING ENHANCED RECEPTION SENSITIVITY IN WIDE BANDS

(75) Inventor: Makoto Shigihara, Fukushima-ken (JP)

(73) Assignee: ALPS Electric Co., Ltd., Ota-Ku, Tokyo (JP)

( * ) Notice: Subject to any disclaimer, the term of this patent is extended or adjusted under 35 U.S.C. 154(b) by 0 days.

(21) Appl. No.: 11/363,914

(22) Filed: Feb. 27, 2006

(65) Prior Publication Data

US 2006/0139227 A1 Jun. 29, 2006

(30) Foreign Application Priority Data

Nov. 9, 2004 (JP) ..... 2004-325464

(51) Int. Cl.
*H01Q 11/12* (2006.01)
*H01Q 9/00* (2006.01)

(52) U.S. Cl. ..... 343/744; 343/745; 343/895

(58) Field of Classification Search ..... 343/744
See application file for complete search history.

(56) References Cited

U.S. PATENT DOCUMENTS 3,946,397 A 3/1976 Irwin

FOREIGN PATENT DOCUMENTS

EP 0863571 A2 9/1998
EP 1557902 A1 7/2005
EP 1580841 A1 7/2005
JP 51-83755 7/1976
JP 2003-101322 4/2003

OTHER PUBLICATIONS

European Search Report dated Apr. 6, 2006 from corresponding European Application No. 06003971.6—2220.

*Primary Examiner*—Trinh Vo Dinh
(74) *Attorney, Agent, or Firm*—Beyer Weaver LLP

(57) ABSTRACT

An antenna device includes a rectangular parallelepiped base member made of a dielectric or magnetic material, a band-shaped first radiation conductor, including a plurality of divided first radiation conductor portions, spirally wound around the base member, a plurality of variable capacitance elements connected between pairs of adjacent portions and disposed on a upper surface of the base member, and a feeding conductor for supplying a tuning voltage to the variable capacitance elements. The first radiation conductor has first radiation conductor parts respectively formed on upper, lower, and rear side surfaces of the base member and first connecting through-holes passing through the upper and lower surfaces are provided in the base member, and the first radiation conductor part on the upper surface and the first radiation conductor part on the lower surface are connected to each another by the first through-holes, and the feeding conductor is disposed on the front surface of the base member.

3 Claims, 2 Drawing Sheets

ANTENNA DEVICE HAVING ENHANCED RECEPTION SENSITIVITY IN WIDE BANDS

BACKGROUND OF THE INVENTION

1. Field of the Invention

The present invention relates to an antenna device that can be tuned to wideband frequencies.

2. Description of the Related Art

A known antenna device 10 is described with reference to FIGS. 4 and 5. A conductor 12 made of a fine metal wire is spirally wound around a ferrite magnetic core 14. Ends of the conductor 12 form connection terminals 16 and 18. The conductor 12 includes a plurality of divided conductor portions 12', and the conductor portions 12' are connected to one another by a plurality of capacitance elements 20. As shown in FIGS. 4 and 5, the antenna device 10 is such that the capacitance elements 20 are physically distributed in the conductor 12 to have a closed loop form. The antenna device 10 responds to a particular frequency (see, for example, Japanese Unexamined Patent Application Publication No. 51-83755 (FIGS. 1 and 3) and its corresponding U.S. Pat. No. 3,946,397).

The known antenna device resonates with a particular frequency. Thus, when the known antenna device receives over wide bands, its reception sensitivity in frequencies other than the particular frequency decreases.

SUMMARY OF THE INVENTION

It is an object of the present invention to provide an antenna device by which enhanced reception sensitivity can automatically be obtained in wide bands.

According to an aspect of the present invention, an antenna device is provided which includes a rectangular parallelepiped base member made of a dielectric or magnetic material, a band-shaped first radiation conductor, including a plurality of divided first radiation conductor portions, spirally wound around the base member, a plurality of variable capacitance elements connected between pairs of adjacent portions among the divided first radiation conductor portions and disposed on an upper surface of the base member, and a feeding conductor for supplying a tuning voltage to the variable capacitance elements. The first radiation conductor has first radiation conductor parts respectively formed on upper, lower, and rear side surfaces of the base member and first connecting through-holes passing through the upper and lower surfaces are provided in the base member, and the first radiation conductor part on the upper surface and the first radiation conductor part on the lower surface are connected to each another by the first through-holes, and the feeding conductor is disposed on a front surface of the base member.

Preferably, the variable capacitance elements include varactor diodes, the adjacent divided first radiation conductor portions are alternately connected between pairs of anodes of the varactor diodes and between pairs of cathodes of the varactor diodes, and a ground conductor formed at least on the lower and front surfaces is provided at one end of the base member. Second through-holes passing through the upper and lower surfaces may be provided and connected to the ground conductor on the lower surface, and may be connected to the divided first radiation conductor portions, which are connected between the varactor diodes on the upper surface through a first resistor. The first radiation conductor portions, which are connected between the pairs of cathodes of the varactor diodes, may be connected to the feeding conductor by a second resistor, and the first and second resistors may be disposed on the upper surface of the base member.

An antenna feeding conductor coupled with the first radiation conductor is disposed on the front surface.

The antenna device may further include a second radiation conductor wound around the base member. The second radiation conductor may be connected to the first radiation conductor by switching elements, with the switching elements disposed on the upper surface of the base member, and a switching voltage feeding conductor for applying a switching voltage for controlling the switching elements to be opened and closed may be disposed on the front surface of the base member.

According to the present invention, an antenna device includes a rectangular parallelepiped base member made of a dielectric or magnetic material, a band-shaped first radiation conductor, including a plurality of divided first radiation conductor portions, spirally wound around the base member, a plurality of variable capacitance elements connected between pairs of adjacent portions among the divided first radiation conductor portions and disposed on an upper surface of the base member, and a feeding conductor for supplying a tuning voltage to the variable capacitance elements. The first radiation conductor has first radiation conductor parts respectively formed on upper, lower, and rear side surfaces of the base member and first connecting through-holes passing through the upper and lower surfaces are provided in the base member, and the first radiation conductor part on the upper surface and the first radiation conductor part on the lower surface are connected to each another by the first through-holes, and the feeding conductor is disposed on a front surface of the base member. Thus, in addition to obtaining good reception sensitivity, a bias feeding conductor for feeding a variable capacitance element tuning voltage can be disposed on a front surface of a base member, which is effective in reducing antenna device size.

In addition, according to the present invention, the variable capacitance elements include varactor diodes, the adjacent divided first radiation conductor portions are alternately connected between pairs of anodes of the varactor diodes and between pairs of cathodes of the varactor diodes, and a ground conductor formed at least on the lower and front surfaces is provided at one end of the base member. Second through-holes passing through the upper and lower surfaces are provided and connected to the ground conductor on the lower surface, and are connected to the divided first radiation conductor portions, which are connected between the varactor diodes on the upper surface through a first resistor. The first radiation conductor portions, which are connected between the pairs of cathodes of the varactor diodes, are connected to the feeding conductor by a second resistor, and the first and second resistors are disposed on the upper surface of the base member. Thus, antenna device size can further be reduced.

According to the present invention, an antenna feeding conductor coupled with the first radiation conductor is disposed on the front surface. Thus, establishing connection to a receiver circuit is facilitated.

Moreover, according to the present invention, an antenna device further includes a second radiation conductor wound around the base member. The second radiation conductor is connected to the first radiation conductor by switching elements, with the switching elements disposed on the upper surface of the base member, and a switching voltage feeding conductor for applying a switching voltage for controlling the switching elements to be opened and closed is disposed on the front surface of the base member. Thus, an antenna device that performs reception while switching two bands can be reduced in size.

DESCRIPTION OF THE PREFERRED EMBODIMENTS

Figure 1:
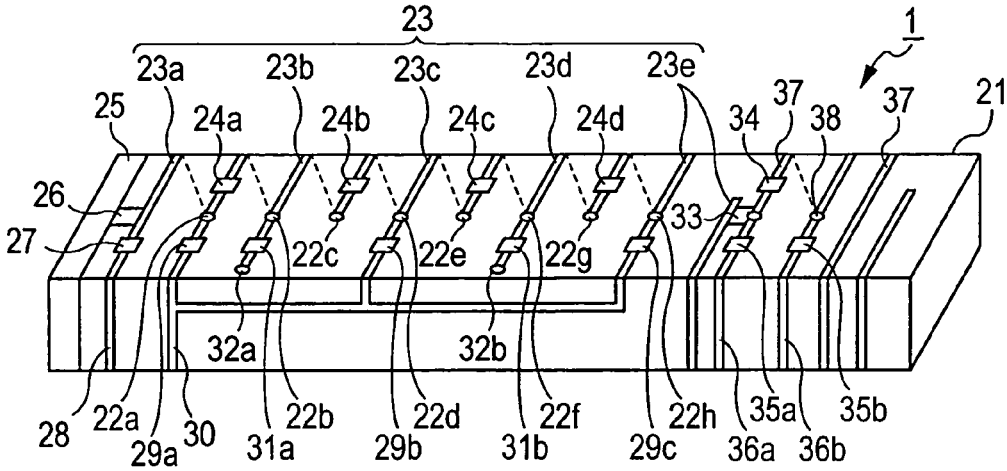
FIG. 1 is a perspective view of an antenna device of the present invention.

An antenna device 1 of the present invention is described below with reference to FIGS. 1 to 3. FIG. 1 is a perspective view, FIG. 2 is a lower view of the antenna device 1, and FIG. 3 shows an equivalent circuit.

Figure 2:
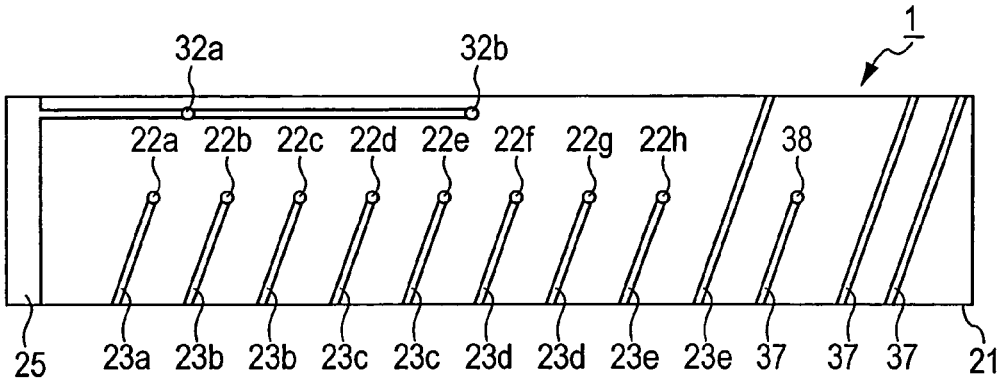
FIG. 2 is a lower view of the antenna device of the present invention.
Figure 3:
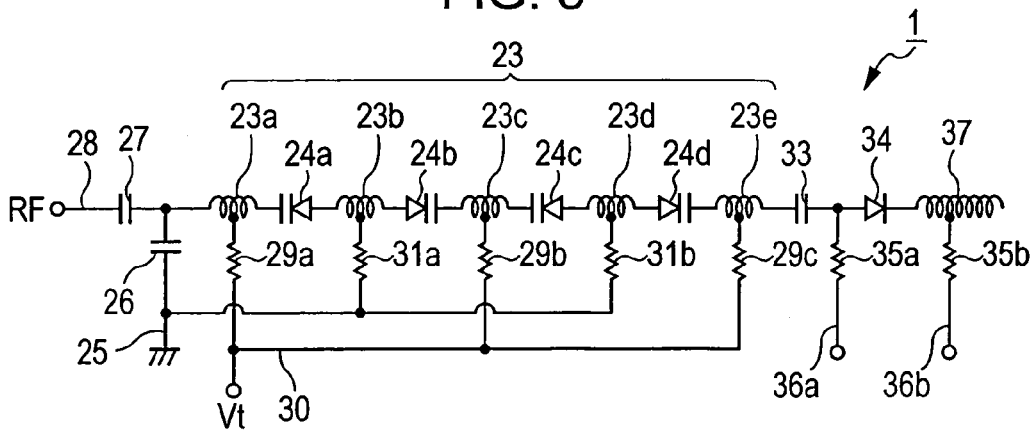
FIG. 3 is an equivalent circuit diagram of the antenna device of the present invention.
Figure 4:
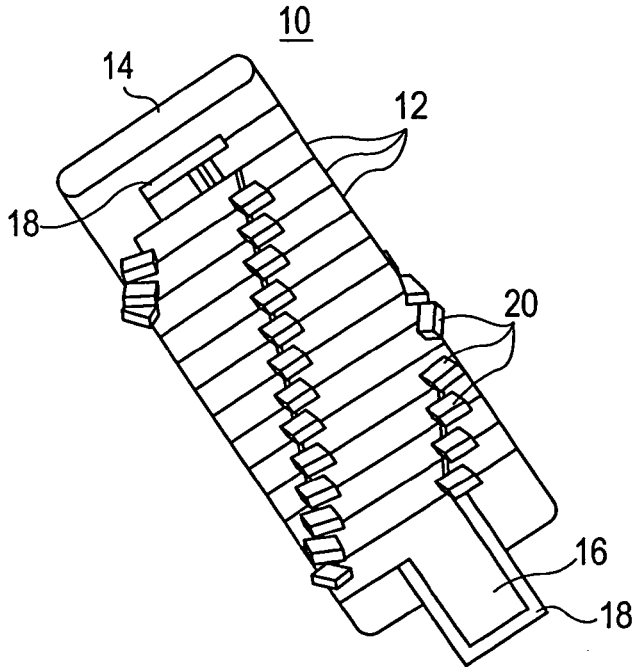
FIG. 4 PRIOR ART
FIG. 4 is a perspective view of a known antenna device.
Figure 5:
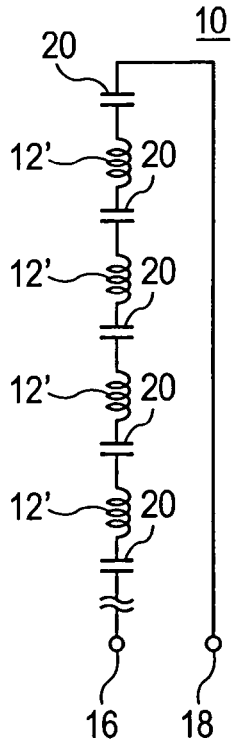
FIG. 5 PRIOR ART
FIG. 5 is an equivalent circuit diagram of the known antenna device.

Referring to FIGS. 1 and 2, on upper, rear side, and lower surfaces of a rectangular parallelepiped base member 21 made of a dielectric or magnetic material, a band-shaped first radiation conductor 23 in which radiation conductor portions are formed is spirally wound is formed through a plurality of first through-holes (two-sided conduction holes) 22 (22*a* to 22*h*) penetrating the upper and lower surfaces of the base member 21. The first radiation conductor 23 includes a plurality of divided radiation conductor portions 23*a* to 23*e*, and the divided radiation conductor portions 23*a* to 23*e* are connected in series by varactor diodes (variable capacitance elements) 24 (24*a* to 24*d*). As shown in FIG. 3, among the varactor diodes 24, pairs of adjacent varactor diodes each have opposing anodes and opposing cathodes.

In other words, the cathode of the leftmost varactor diode 24*a* is connected to the radiation conductor portion 23*a*, and the anode of the varactor diode 24*a* is connected to the radiation conductor portion 23*b*. The anode of the following varactor diode 24*b* is connected to the radiation conductor portion 23*b*, and the cathode of the varactor diode 24*b* is connected to the radiation conductor portion 23*c*. The cathode of the following varactor diode 24*c* is connected to the radiation conductor portion 23*c*, and the anode of the varactor diode 24*c* is connected to the radiation conductor portion 23*d*. The anode of the following varactor diode 24*d* is connected to the radiation conductor portion 23*d*, and the cathode of the varactor diode 24*d* is connected to the radiation conductor portion 23*e*.

At one end of the base member 21, a ground conductor 25 is formed on four surfaces, that is, upper, lower, rear side, and front surfaces of the base member 21. On the upper surface of the base member 21, an impedance-matching capacitor 26 is disposed which connects, to the ground conductor 25, the radiation conductor portion 23*a* at a position closest to the ground conductor 25. The radiation conductor portion 23*a* is coupled with an antenna feeding conductor 28 by a first coupling capacitor 27. The antenna feeding conductor 28 extends from the upper surface to the front surface.

A first resistor 29*a* is connected to the radiation conductor portion 23*a* by the first through-hole 22*a*, and the first resistor 29*a* is connected to a bias feeding conductor 30. The bias feeding conductor 30 extends from the upper surface to the front surface. A second resistor 31*a* is connected to the following radiation conductor portion 23*b* by the first through-hole 22*b*, and the second resistor 31*a* is connected to a second through-hole 32*a*. A first resistor 29*b* is connected to the following radiation conductor portion 23*c* by the first through-hole 22*d*, and the first resistor 29*b* is connected to the bias feeding conductor 30. A second resistor 31*b* is connected to the following radiation conductor portion 23*d* by the first through-hole 22*f*, and the second resistor 31*b* is connected to the second through-hole 32*b*. A first resistor 29*c* is connected to the following radiation conductor portion 23*e* by the first through-hole 22*h*, and the first resistor 29*c* is connected to the bias feeding conductor 30. The first and second resistors 29 and 31 are also disposed on the upper surface of the base member 21.

The second through-holes 32*a* and 32*b* are two-sided conduction holes, and they establish connection to the ground conductor 25 on the back side. In the above-described connections, each varactor diode 24 has an anode connected to the ground conductor 25 and a cathode connected to the bias feeding conductor 30.

An end of the last divided first radiation conductor portion 23*e* serves as a first open end, and is connected to a diode (switching element) 34 by a second coupling capacitor 33 disposed on the upper surface of the base member 21. A node between the second coupling capacitor 33 and the diode 34 is connected to a switching voltage feeding conductor 36*a* by a third resistor 35*a*. The second coupling capacitor 33 and the diode 34 are disposed on the upper surface of the base member 21, and the switching voltage feeding conductor 36*a* extends from the upper surface to the front surface. A second radiation conductor 37 is connected to the diode 34. The second radiation conductor 37 is also wound around the base member 21, and is partly wound through a third through-hole 38. A third resistor 35*b* is connected to the second radiation conductor 37 through the third through-hole 38, and is connected to a switching voltage feeding conductor 36*b*. The switching voltage feeding conductors 36*a* and 36*b* are arranged in parallel on the front surface.

The antenna device 1 having the above-described configuration is used in, for example, a portable device (e.g., a cellular phone) assumed to receive analog television broadcasting or digital terrestrial television broadcasting, and is mounted on a motherboard of the portable device. The antenna feeding conductor 28 is connected to a tuner circuit (RF) formed on the motherboard. In addition, a tuning voltage Vt is supplied from the motherboard to the bias feeding conductor 30, and the ground conductor 25 is grounded on the motherboard. This applies the tuning voltage Vt between ends of the varactor diodes 24. Also, the switching voltage feeding conductors 36*a* and 36*b* are supplied with a switching voltage from the motherboard.

An electrical length of the first radiation conductors 23 is set to resonate with, for example, the UHF band (470 MHz to 770 MHz) within a variable capacitance range of the varactor diodes 24. Therefore, when the diode 34 is off (opened), the antenna device 1 can receive a television signal having an arbitrary frequency in the UHF band since an end of the radiation conductor portion 23*e* serves as an open end.

In addition, the electrical length of the entirety of the first radiation conductors 23 and the second radiation conductor 37 so as to resonate with the VHF band within a variable capacitance range of the varactor diode 24, when the switching element 34 is turned on (short-circuited), the end of the second radiation conductor 37 serves as an open end, whereby the antenna device 1 can receive a television signal.

In the present invention, the first radiation conductor 23 is wound around the base member 21 through the first through-holes 22. Thus, the bias feeding conductor 30 for feeding the tuning voltage to the varactor diode 24 can be disposed on the front surface, which is effective in reducing the size of the antenna device 1.

What is claimed is:

1. An antenna device comprising:

a rectangular parallelepiped base member made of a dielectric or magnetic material;

a band-shaped first radiation conductor, including a plurality of divided first radiation conductor portions, spirally wound around the base member;

variable capacitance elements connected in series between adjacent pairs of the divided first radiation conductor portions and disposed on an upper surface of the base member; and a feeding conductor for supplying a timing voltage to the variable capacitance elements, wherein the first radiation conductor has first radiation conductor parts respectively formed on upper, lower, and rear side surfaces of the base member and first connecting through-holes passing through the upper and lower surfaces are provided in the base member;

the first radiation conductor part on the upper surface and the first radiation conductor part on the lower surface are connected to each another by the first through-holes, and the feeding conductor is disposed on a front surface of the base member;

the variable capacitance elements includes varactor diodes, the adjacent divided first radiation conductor portions are alternately connected between pairs of anodes of the varactor diodes and between pairs of cathodes of the varactor diodes, and a ground conductor formed at least on the lower and front surfaces is provided at one end of the base member;

second through-holes passing through the upper and lower surfaces are provided and connected to the ground conductor on the lower surface, and are connected between the varactor diodes on the upper surface by a first resistor; and the first radiation conductor portions, which are connected between the pairs of cathodes of the varactor diodes, are connected to the feeding conductor by a second resistor, and the first and second resistors are disposed on the upper surface of the base member.

2. The antenna device according to claim 1, wherein an antenna feeding conductor coupled with the first radiation conductor is disposed on the front surface.

3. The antenna device according to claim 1, further comprising a second radiation conductor wound around the base member, wherein the second radiation conductor is connected to the first radiation conductor by switching elements, with the switching elements disposed on the upper surface of the base member, and a switching voltage feeding conductor for applying a switching voltage for controlling the switching elements to be opened and closed is disposed on the front surface of the base member.

* * * * *